US005622018A

United States Patent [19]

Schiedegger

[11] Patent Number: 5,622,018

[45] Date of Patent: Apr. 22, 1997

[54] SUPPORT RAIL END CAP FOR A COMPONENT SHUTTER

[75] Inventor: Charles E. Schiedegger, Metamora, Mich.

[73] Assignee: Tapco International, Plymouth, Mich.

[21] Appl. No.: 488,043

[22] Filed: Jun. 7, 1995

[51] Int. Cl.[6] ..... E06B 1/04

[52] U.S. Cl. ..... 52/211; 52/473; 52/656.7; 52/212; 52/213

[58] Field of Search ..... 52/473, 211, 212, 52/213, 216, 476, 656.7

[56] References Cited

U.S. PATENT DOCUMENTS

| | | | |
|---|---|---|---|
| 4,765,110 | 8/1988 | MacLeod | 52/473 |
| 5,347,782 | 9/1994 | Vagedes | 52/473 |

FOREIGN PATENT DOCUMENTS

| | | | |
|---|---|---|---|
| 2055940 | 3/1981 | United Kingdom | 52/473 |

*Primary Examiner*—Carl D. Friedman
*Assistant Examiner*—W. Glenn Edwards
*Attorney, Agent, or Firm*—Harness, Dickey & Pierce, P.L.C.

[57] ABSTRACT

A component shutter having a plurality of end caps for closing off the outermost longitudinal ends of each of a pair of side rails of the shutter and providing a decorative, finished appearance to the outermost longitudinal ends of each of the side rails. The end caps comprise a top portion and a tongue portion, with the tongue portion being sized to fit within a pocket formed between the side rail and either a top or bottom end rail. The tongue portion is slidably inserted into the pocket. The end cap forms a finished appearing edge surface for an end of the side rail of the shutter.

2 Claims, 9 Drawing Sheets

SUPPORT RAIL END CAP FOR A COMPONENT SHUTTER

BACKGROUND OF THE INVENTION

1. Technical Field

This invention relates to decorative component shutters and more particularly to an end cap for use with a component shutter which provides a finished edge appearance to an edge of a side rail of the shutter.

2. Discussion

Decorative component shutters are used in a wide-variety of applications to provide a decorative appearance, typically to the exterior of buildings. Such shutters are typically placed on both sides of a window of a building, or even a door.

More recently, component shutter assemblies having individual component parts molded from various plastics have become popular. By "component" it is meant shutters which are quickly and easily assembled from several individual component parts which are molded independently of one another prior to assembly. Typically, such component parts are either injection molded or extruded from various thermoplastics.

The typical component shutter includes a pair of side rails, at least one louver or panel section which is engageable with a track portion of each side rail, and at least one end rail positioned at either an upper or lower end of the shutter. More typically, two end rails are used, one at the top of the side rails and one at the bottom of the side rails. By cutting the side rails and the center louvered or panel section to the desired length, the overall shutter length can easily be tailored to meet the needs of specific applications.

With component shutters the side rails are specifically intended to be cut to specific lengths prior to assembly of the shutter. The side rails are typically not formed with a cover or any form of cap at each outer end thereof to provide a finished appearance to the outermost ends of each side rail. While this could be accomplished by injection molding the side rail to include covers at each outermost end thereof, the resulting side rail would only be useable for a shutter having a specific length. Accordingly, this would require different injection molding tools to produce side rails of differing lengths which each have covered end portions. The high cost of injection molding tooling, however, would significantly add to the cost of each overall model (i.e., size) of shutter if the manufacturer was forced to use different molding tools to form side rails of different lengths. Thus, it is much more economical to use a single extrusion die to form a long section of side rail which may then be cut into two or more smaller lengths for use in assembling shutters having different overall lengths.

While the above-described method of extrusion molding long sections of side rail and then cutting each side rail to the length needed does promote economical manufacture of component shutters having various overall lengths, since the side rails are not formed with any end covering, each end of the side rail has a somewhat unfinished appearance once the shutter assembly is completely assembled. The ends of each side rail have an even more unfinished appearance if one or both of the ends have been cut prior to assembly of the shutter.

Accordingly, it would be highly desirable to be able to keep forming the side rails through extrusion molding techniques, which enables the side rails to be economically formed in long lengths and then cut to two or more smaller lengths, but to eliminate the unfinished appearing edges of the side rails. More specifically, it would be highly desirable to provide some form of additional component part which could be quickly and easily assembled to the outermost ends of each side rail to provide a finished appearance to each outermost end of each side rail of the shutter.

It is therefore a principal object of the present invention to provide a means by which the exposed, cut edges of each side rail of a component shutter may be covered quickly and easily with a simple, additional assembly step to provide a finished appearance to each edge of each side rail of a component shutter.

It is a further object of the present invention to provide an end cap for a component shutter assembly which may be quickly and easily slidably inserted into an exposed end portion of a side rail of a component shutter to thereby provide a finished looking edge surface to that particular end of the side rail.

It is still a further object of the present invention to provide an end cap for use with a component shutter, in which the end cap may be quickly and easily molded from a suitable thermoplastic to produce an inexpensive means for providing a finished looking edge to an outermost end of a side rail of the component shutter.

It is yet another object of the present invention to provide an end cap for covering an open end of a side rail of a component shutter, where the end cap may be quickly and easily inserted into the open end of the side rail during assembly of the shutter to thereby provide a decorative finished appearance to the outermost edge of the side rail.

It is further an object of the present invention to provide a means for closing-off the exposed edge portions of the side rails of a component shutter without adding appreciably to the overall cost of the component shutter.

SUMMARY OF THE INVENTION

The above and other objects are provided by an end cap in accordance with preferred embodiments of the apparatus and method of the present invention. The end cap is adapted to be used with a component shutter assembly having at least one side rail and at least one end rail, and more preferably a pair of side rails and a pair of end rails. The end cap is adapted to be inserted within a pocket formed at an outermost edge of the side rail between a top surface of the end rail and a front wall of the side rail. Once the end cap is slid into the pocket, the end cap covers the exposed edge of the side rail and the pocket formed between the side rail and the top rail to provide a decorative, finished appearance to the side rail.

In the preferred embodiment, the end cap includes a planar top wall portion and a tongue portion. The cross-sectional width of the tongue portion is less than the cross-sectional width of the planar top portion such that a shoulder is formed by the top portion. During assembly, the shoulder rests on an edge of the front wall portion of the sidewall such that the end cap does not simply slide into the pocket. The shoulder also helps to provide the appearance of a finished looking edge to the sidewall.

The end cap is easily formed from conventional molding techniques such as injection molding to provide an inexpensive component part which provides a finished appearing edge to each end of each side rail of the component shutter. The end cap is further quickly and easily assembled to the component shutter without significantly increasing the complexity of the assembly or the overall cost of the component shutter.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
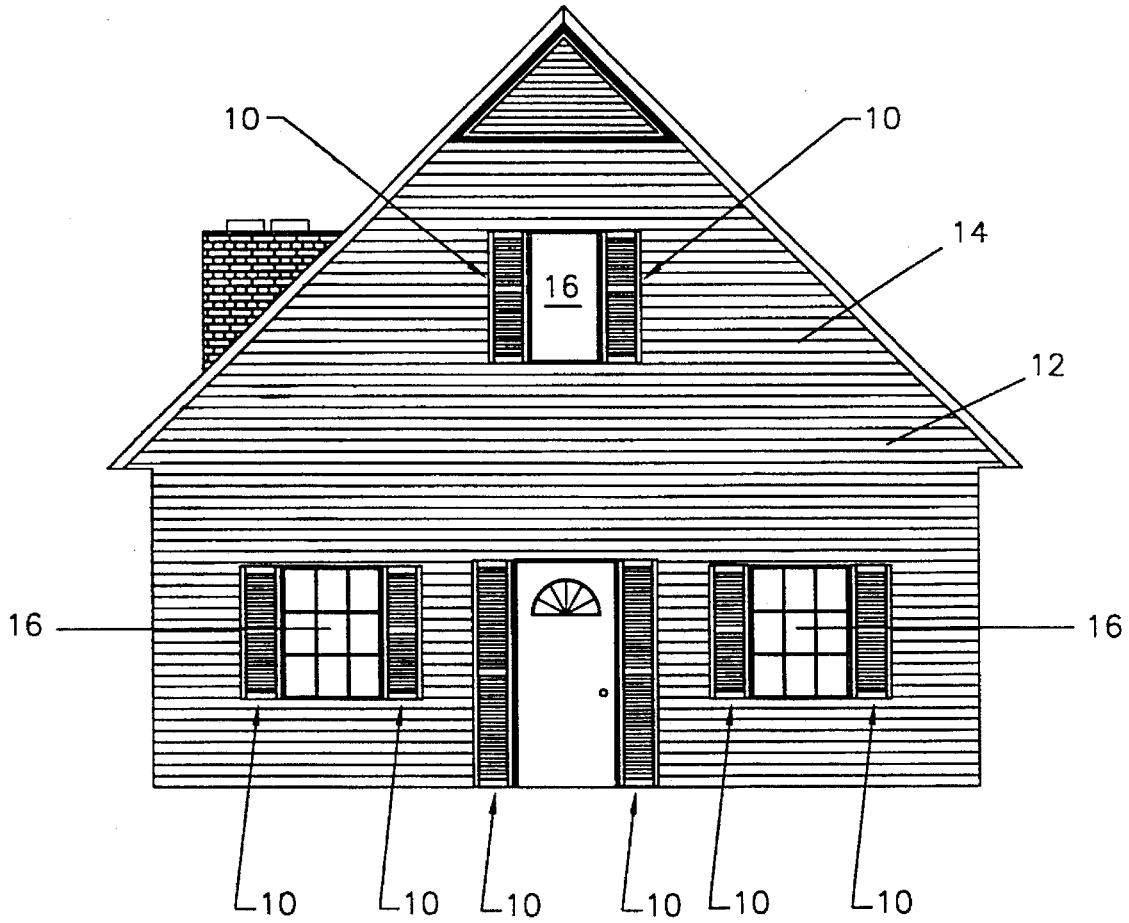
FIG. 1 is an elevational view of a front of a building showing typical placement of a plurality of component shutters of the present invention on opposite sides of the windows of the building.

Referring to FIG. 1, there is shown a plurality of component shutters 10 in accordance with the preferred embodiments of the present invention. Each of the shutters 10 are disposed on an outer surface 12 of a building 14 on opposite sides of windows 16 of the building 14. The shutters 10 are each secured by any conventional means to the outer surface 12 of the building 14.

Figure 2:
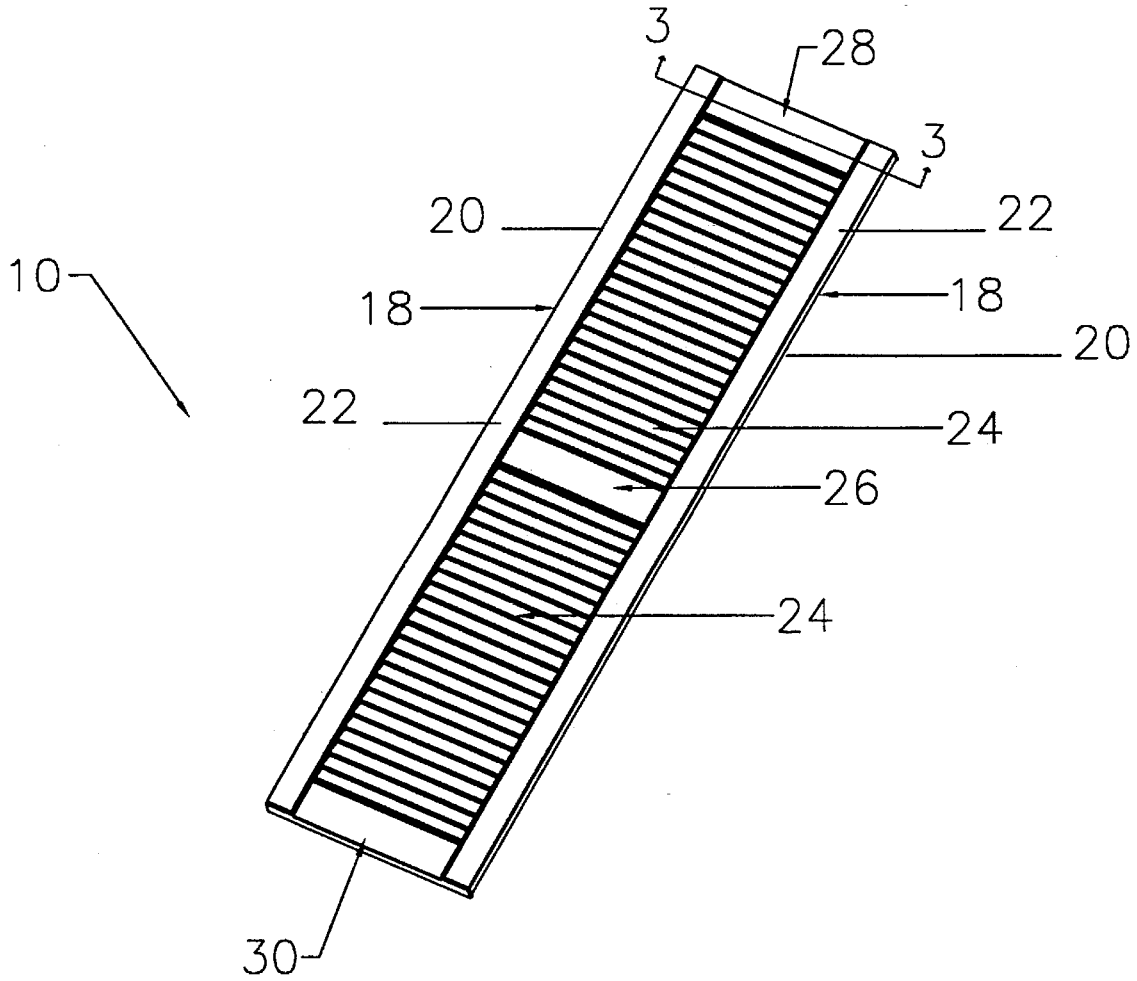
FIG. 2 is an enlarged perspective view of one of the shutters shown in FIG. 1.

Referring to FIG. 2, each component shutter 10 comprises a pair of side rails 18 each having a sidewall portion 20 and a front wall 22. Disposed between the side rails 18 are one or more louvered center sections 24 and at least one center panel 26, known generally in the art as a "mullion". At opposing longitudinal ends of the side rails 18 is a top end rail 28 and a bottom end rail 30. It will be appreciated immediately, however, that the shutter 10 could easily be formed by incorporating more than the two louvered center sections 24 if desired. Additionally, more than one center panel 26 could be included if, for example, three center sections 24 are included. Still further, while the center sections 24 are shown as louvered sections, one or more of these sections could just as easily be replaced by a solid panel to vary the aesthetic appearance of the shutter 10. Each of the side rails 18 are also identical in construction, and the top end rail 28 and the bottom end rail 30 are similar in overall construction and differ principally in the overall height of each. The top end rail 28 may also incorporate a "cathedral arch" to provide an even further aesthetically pleasing appearance. Likewise, the two center sections 24 are of identical construction, but may also differ in overall height.

Figure 3:
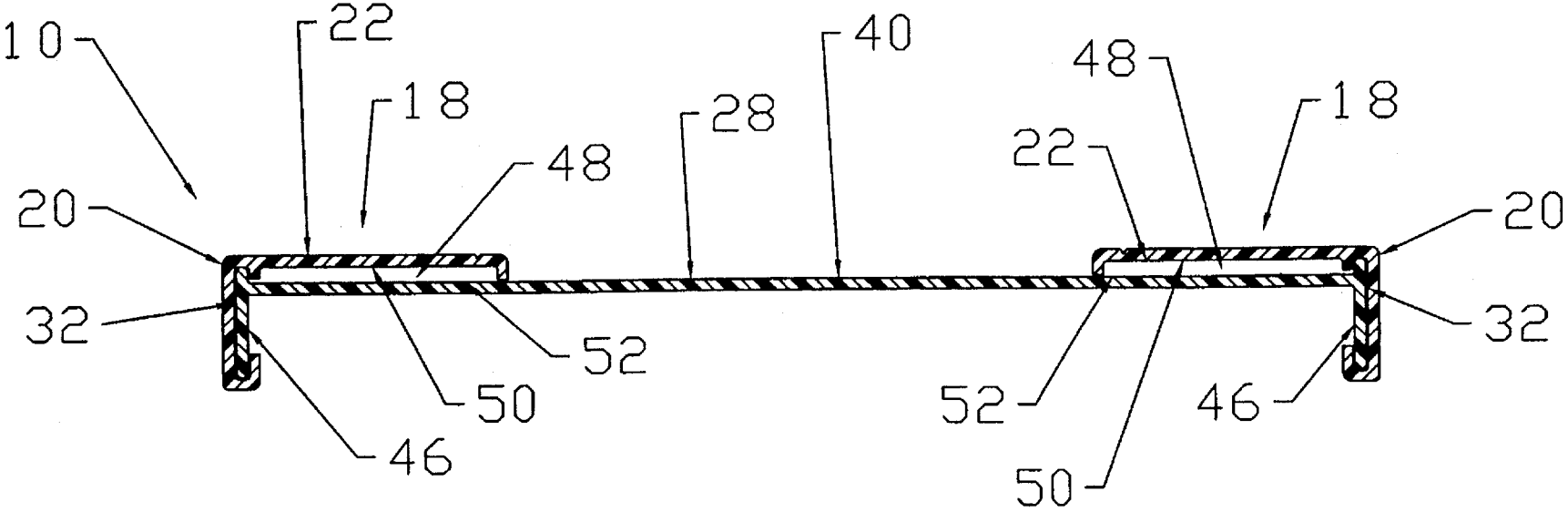
FIG. 3 is a cross-sectional view of the side rails and the top end rail of the shutter in FIG. 2 taken in accordance with section line 3—3 in FIG. 2.
Figure 6:
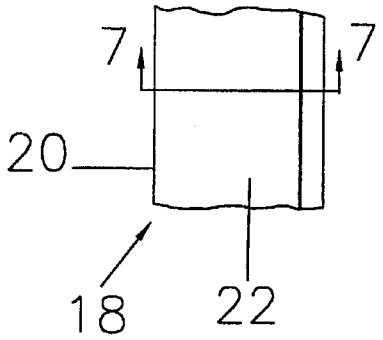
FIG. 6 is a plan view of a portion of the side rail of the shutter shown in FIG. 2.
Figure 7:
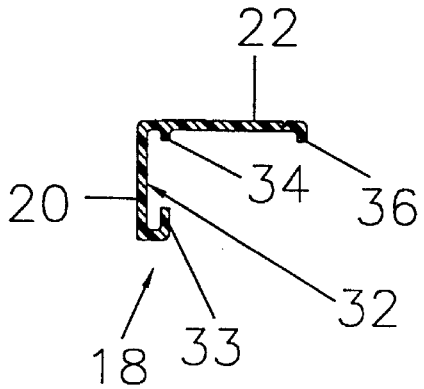
FIG. 7 is cross-sectional view of the side rail of FIG. 6 taken in accordance with section line 7—7 in FIG. 6.

With brief reference to FIGS. 3 and 7, the sidewall 20 of each side rail 18 is shaped so as to form an internal C-track 32, the purpose of which will be described momentarily. The C-track 32 is formed in part by a rib portion 34 projecting inwardly from the front wall 22 and a lip portion 33 extending from the sidewall portion 20. An outermost lip 36 is also formed which has a length sufficient to contact the top end rail 28 (or bottom end rail 30) when the side rails 18 are assembled to the end rails 28 and 30. Advantageously, the lip portion 33 and rib portion 34 are not visible from the front of the side rail 18, as shown in FIG. 6.

Figure 4:
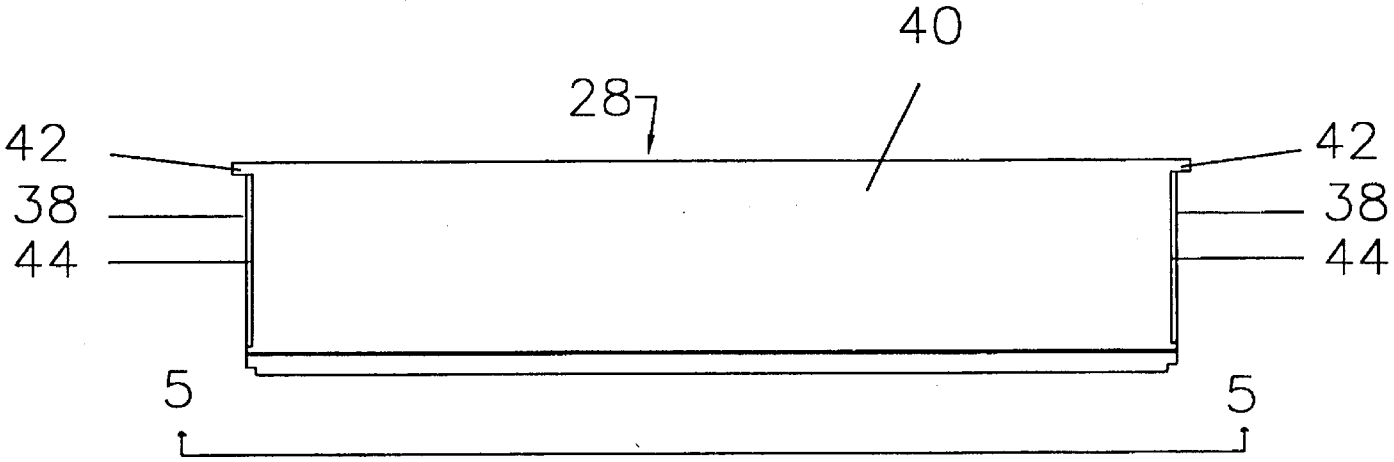
FIG. 4 is a plan view of the top end rail shown in FIG. 2.
Figure 5:
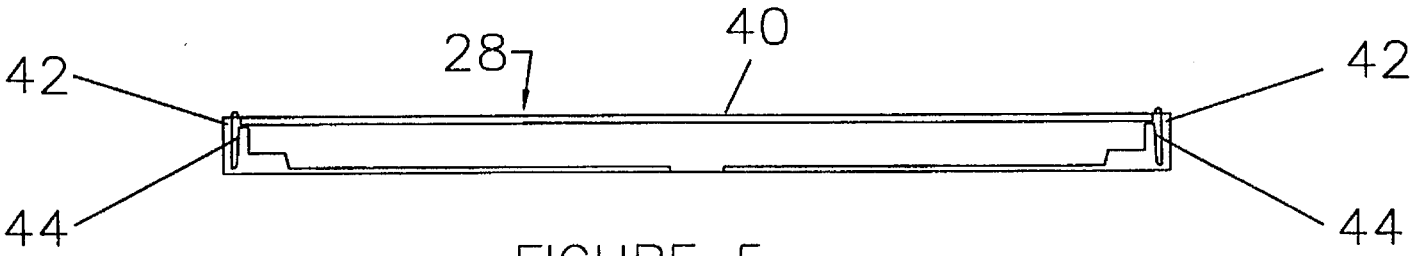
FIG. 5 is a bottom view of the top end rail shown in FIG. 4 in accordance with directional line 5—5 in FIG. 4.

Referring now to FIG. 4, the top end rail 28 can be seen to include a raised rib 38 formed on an outer surface 40 thereof at each longitudinal end. Further included is a ledge 42 which is formed at each opposite longitudinal end and which projects outwardly from sidewalls 44 of the top end rail 28. For aesthetic purposes, the top end rail 28 could optionally include a "cathedral arch" on the outer surface 40 thereof.

Referring again to FIG. 3, the top end rail 28 can be seen to include at each end thereof a planar portion 46 extending perpendicular to the front wall 22 of the side rail 18. Each planar portion 46 is slidably inserted into the C-track 32 of each side rail 18. Once the top end rail 28 is assembled to the side rails 18, a pocket 48 is formed between an inside surface 50 of the front wall 22 and an outer surface 52 of the top end rail 28. The pocket 48 is closed by the rib 34 and the inwardly turned shoulder 36 of each side rail 18. It will be appreciated that the top end rail 28 and bottom end rail 30 are similar in construction, with the possible exception of its overall height and the optional cathedral arch on the top end rail 28 as mentioned earlier herein. Further, it will be appreciated that each center section 24 and the center panel 26 each include a planar member similar to planar portion 46 which slides within the C-track 32 of each side rail 18 and is, therefore, supported between the side rails 18 in conventional fashion.

Figure 8:
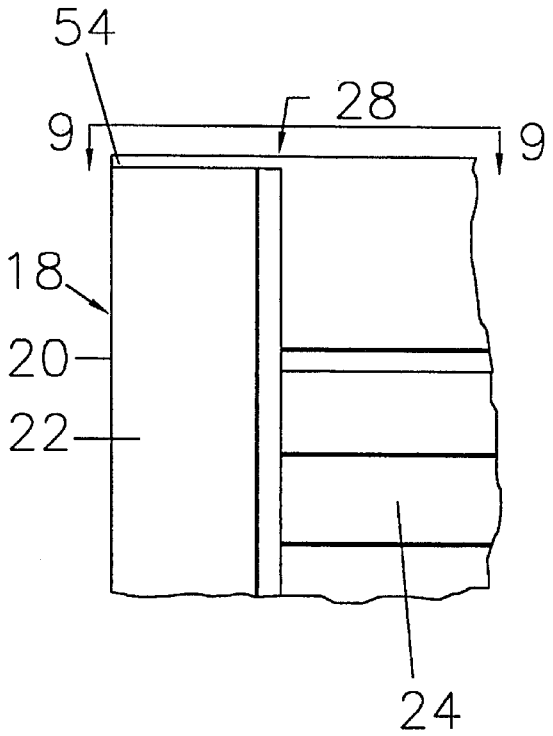
FIG. 8 is a fragmentary view of the upper left corner of the shutter of FIG. 2 without the end cap of the shutter in place.
Figure 11:
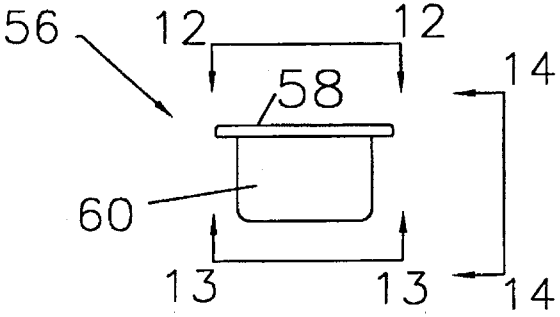
FIG. 11 is a front view of the end cap of FIG. 10.
Figure 10:
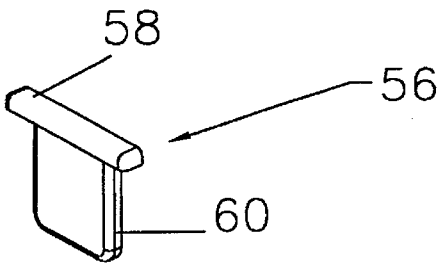
FIG. 10 is a perspective view of an end cap in accordance with a preferred embodiment of the present invention.

Referring now to FIG. 8, a portion of the shutter 10 is shown illustrating in enlarged fashion the exposed, unfinished edge 54 which is formed when the top end rail 28 is assembled to each side rail 18. It will be appreciated that four such unfinished edges 54 would be present on a typical shutter 10 (i.e., two on each side rail 18). The exposed, unfinished edge 54 results from the side rail 18 being cut or to a predetermined length prior to assembling the shutter 10. Although this edge could be eliminated by injection molding each side rail 18 with a cover member to provide a finished appearance to each side rail, this would dictate that the side rail 18 could only be used to form a shutter having a predetermined length. Thus, shutters having different overall sizes would require a plurality of injection molding tools, one for each differing length of side rail 18. As will be appreciated, this would add significant expense to the production of shutters because it would significantly increase the cost of tooling necessary to make side rails having different lengths.

Figure 9:
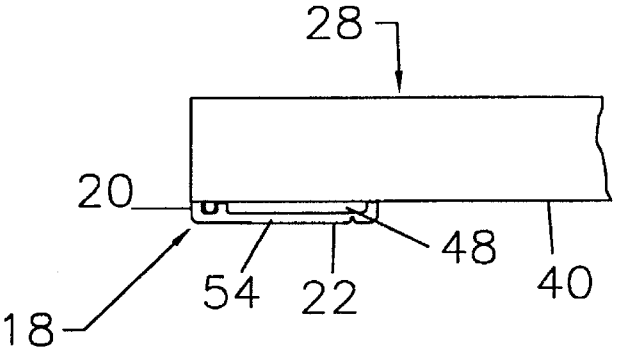
FIG. 9 is a top view of the corner of the shutter shown in FIG. 8 taken in accordance with directional line 9—9 in FIG. 8 showing the pocket which is formed between the front wall of the side rail and the outer surface of the top end rail.
Figure 12:
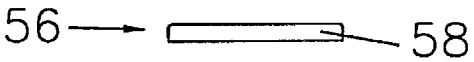
FIG. 12 is a top view of the end cap of FIG. 11 taken in accordance with directional line 12—12 in FIG. 11.
Figure 13:
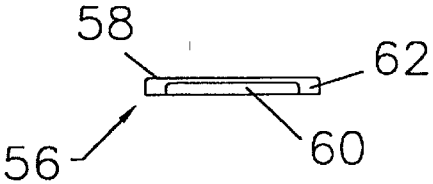
FIG. 13 is a bottom view of the end cap of FIG. 11 taken in accordance with directional line 13—13 in FIG. 11.
Figure 14:
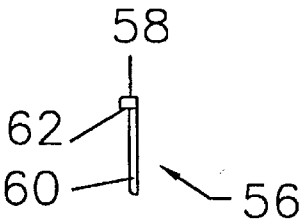
FIG. 14 is a side view of the end cap of FIG. 11 taken in accordance with directional line 14—14 in FIG. 11.

Referring now to FIGS. 10–14, there is shown an end cap 56 in accordance with a preferred embodiment of the present invention. With specific reference to FIGS. 10 and 11, the end cap 56 generally includes a planar top portion 58 and a tongue portion 60. The planar top portion 58 is slightly longer in overall width than the tongue portion 60, with the overall width of the tongue portion 60 being just slightly less than the overall width of the pocket 48 (FIG. 9). With specific reference to FIGS. 13 and 14, the cross-sectional width of the tongue portion 60 is also less than the top portion 58 such that a ledge or shoulder 62 is formed by an overhanging portion of the top portion 58.

Figure 15:
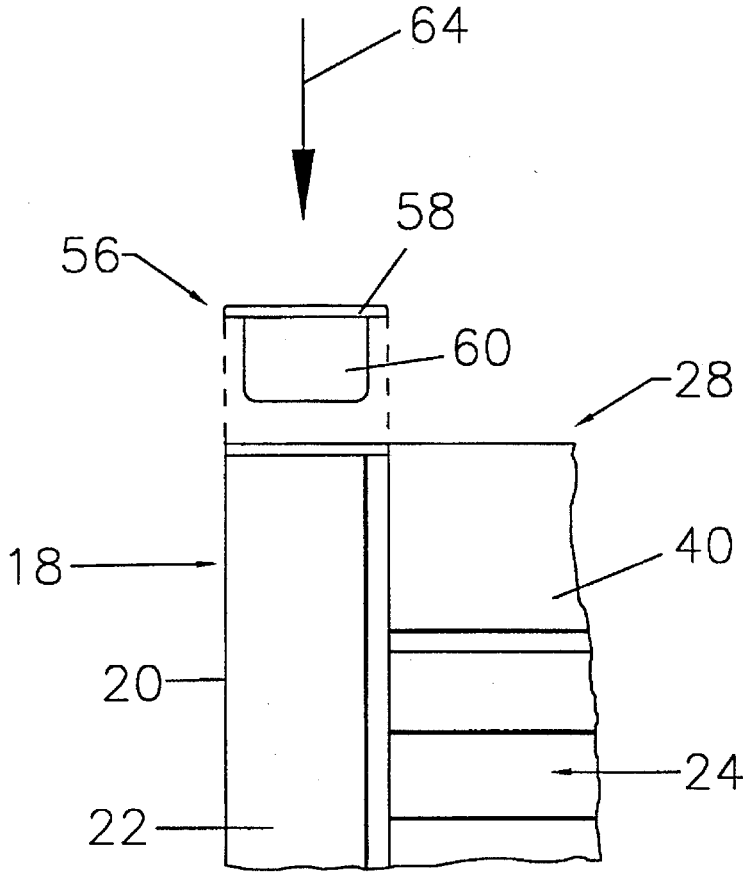
FIG. 15 is a fragmentary view of the upper left corner of the shutter of FIG. 2 showing the end cap about to be inserted into the pocket formed between the front wall of the side rail and the outer surface of the top end rail.
Figure 16:
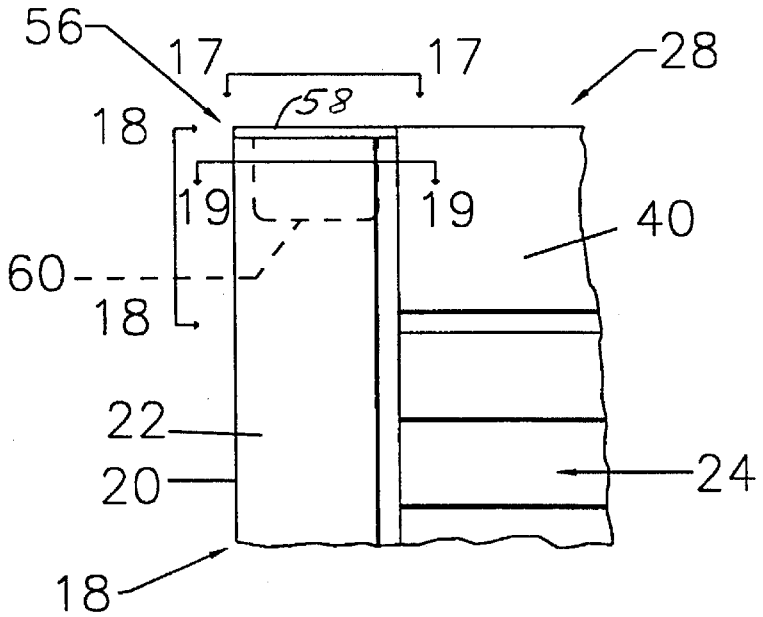
FIG. 16 shows the upper left corner of the shutter of FIG. 15 with the end cap fully inserted into the pocket formed between the side rail and the top end rail.

Referring now to FIGS. 15 and 16, the insertion of the end cap 56 into the side rail 18 will be described. Once the top end rail is slidably engaged within the C-track 32 of the side rail 18, the end cap 56 is positioned with the tongue portion 60 parallel to and positioned over the pocket 48. The end cap 56 is then urged downwardly in accordance with directional arrow 64 such that the tongue portion 60 is inserted within the pocket 48. Since the longitudinal width and cross-sectional thickness of the tongue portion 60 is only just slightly smaller than the internal dimensions of the pocket 48, then the tongue portion 60 becomes slightly wedged into the pocket 48. In this instance, it may not be necessary to permanently fasten the end cap 56 within the pocket 48. In the preferred embodiment, however, ultrasonic welding is used to permanently secure the end cap 56 within the pocket 48. The method of using ultrasonic welding in connection with the assembly of a component shutter is described in co-pending U.S. application entitled "Shutter and Method of Assembly of Same", Ser. No. 08/465,471, filed Jun. 6, 1995, and assigned to the assignee of the present invention, which is hereby incorporated by reference into the present document.

Figure 19:
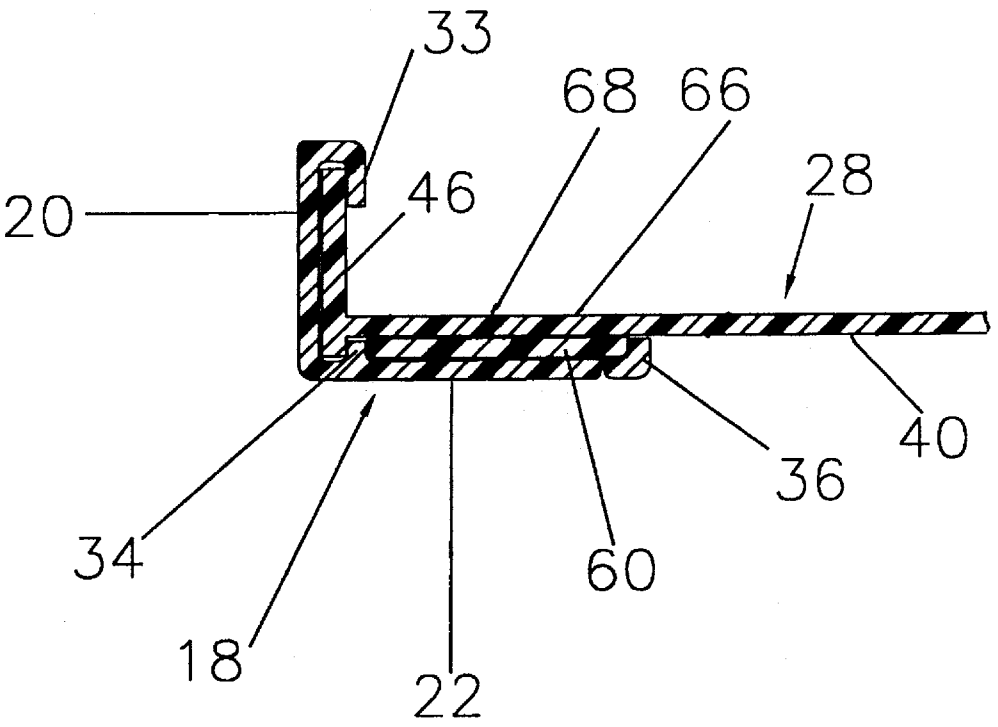
FIG. 19 is a cross-sectional view of the upper left corner of FIG. 16 taken in accordance with section line 19—19 in FIG. 16 showing the tongue portion of the end cap positioned within the pocket formed between the side rail and the top end rail.

With brief reference to FIG. 19, the ultrasonic weld is made on a rear surface 66 of the top end rail 28 at a point 68 which is over the pocket 48 and the tongue portion 60 of the end cap 56. The ultrasonic weld at point 68 causes a bonding of a portion of the material of the tongue portion 60 and the top end rail 28 which is in contact with the tongue portion 60. It will be appreciated that the entire shutter 10 could also easily be secured via ultrasonic welding techniques, as described in the above-referenced co-pending application. After the end cap 56 is ultrasonically welded within the pocket 48, the end cap 56 forms a permanent, non-removable portion of the component shutter 10.

Figure 17:
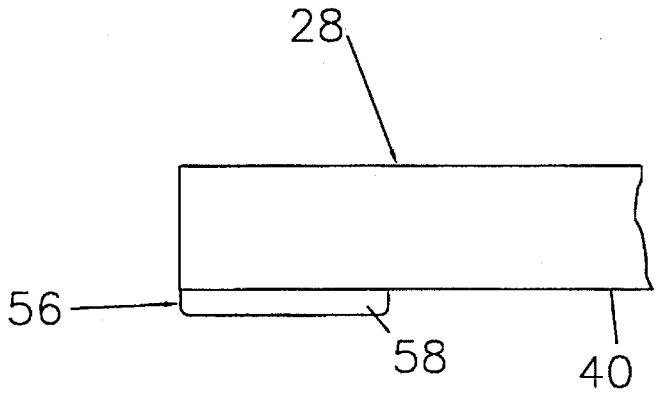
FIG. 17 is a top view of the upper left corner of the shutter shown in FIG. 16 taken in accordance with directional line 17—17 in FIG. 16.
Figure 18:
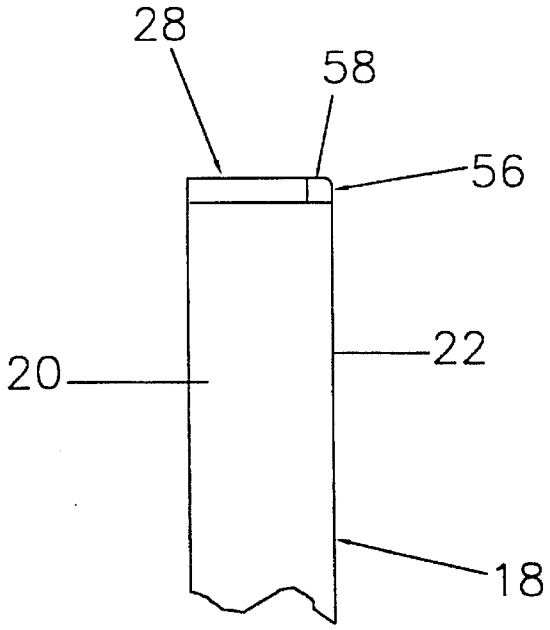
FIG. 18 is a side view of the upper left corner of FIG. 16 taken in accordance with directional line 18—18 in FIG. 16.

The top portion 58 of the end cap 56 also covers the exposed, unfinished edge 54 of the side rail 18 to provide the side rail 18 with a finished, aesthetically pleasing appearance. It will be appreciated that the above-described steps of inserting the end cap 56 and ultrasonically welding or otherwise bonding via adhesives the end cap 56 are performed at four points on a typical rectangular component shutter assembly: one at each outermost edge portion of each side rail 18. With brief reference to FIGS. 17 and 18, and in particular FIG. 18, the finished looking appearance provided by the end cap 56 is clearly apparent.

The end cap 56 thus provides a quick and easy means for closing-off each unfinished edge of a side rail 18 to provide a more finished looking, decorative edge to the side rail 18. The end cap 56 of the present invention further does not add appreciably to the overall cost of the shutter 10 or to the complexity of its manufacture. The end cap 56 is preferably injection molded from polypropylene or polystyrene and further can be inserted into the end of the side rails 18 without the need for special assembly tools. Simply by ultrasonically welding portions of the top and bottom end rails 28 and 30, respectively, or through the use of suitable adhesives, the end caps 56 can be quickly and easily permanently secured to the side rails 18.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A shutter apparatus comprising:

a pair of side rails;

a center section disposed between said side rails;

at least one end rail having a length sufficient to span said center section and having outer end portions adapted to engage with said side rails, said side rails each including a front wall, said end rail and said front wall of side rail forming a pocket at an intersection thereof between a surface of said end rail and a surface of said side rail;

an end cap adapted to slidably engage within said pocket to provide a finished edge surface to said side rail;

said end cap including a planar top portion and a centrally disposed tongue portion, and wherein said surface of said end rail comprises an outer surface thereof, and wherein said surface of said side rail comprises an inner surface thereof;

said tongue portion extending between said outer surface of said end wall and said inner surface of said side rail when said end cap is fully inserted into said pocket;

said planar top portion having a cross-sectional width which is greater than a cross-sectional width of said tongue portion to thereby enable said planar top portion to form a shoulder, said shoulder resting upon an outermost edge portion of said side rail when said end cap is inserted into said pocket.

2. The apparatus of claim 1, wherein said end cap is injection molded from a thermoplastic.

* * * * *